United States Patent [19]

Wissman

[11] Patent Number: 4,722,664

[45] Date of Patent: Feb. 2, 1988

[54] LINED CORROSION RESISTANT PUMP

[75] Inventor: Jack L. Wissman, Xenia, Ohio

[73] Assignee: The Duriron Company, Inc., Dayton, Ohio

[21] Appl. No.: 270,946

[22] Filed: Jun. 5, 1981

[51] Int. Cl.[4] ..... F01D 25/26

[52] U.S. Cl. ..... 415/197; 415/214

[58] Field of Search ..... 415/196, 197, 214, 197; 427/34; 264/273, 274, 127, 269

[56] References Cited

U.S. PATENT DOCUMENTS

| | | | |
|---|---|---|---|
| 1,233,115 | 7/1917 | Osborne | 415/197 |
| 1,404,712 | 1/1922 | Binder | 415/214 |
| 1,591,939 | 7/1926 | Humphrey | 415/197 X |
| 1,643,874 | 9/1927 | Cawood | 415/214 |
| 1,925,898 | 9/1933 | Fritz | 415/197 X |
| 1,949,135 | 2/1934 | Wirth . | |
| 1,955,292 | 4/1934 | Heintz . | |
| 2,107,260 | 2/1938 | Ihara | 415/197 |
| 2,255,239 | 9/1941 | Allen | 415/197 |
| 2,335,872 | 12/1943 | Mitchell | 264/147 X |
| 2,974,684 | 3/1961 | Ginaven et al. . | |
| 3,020,850 | 2/1962 | Mechenstock | 415/197 X |
| 3,094,075 | 6/1963 | Logue | 415/197 X |
| 3,146,722 | 9/1964 | Warman | 415/197 X |
| 3,308,225 | 3/1967 | Wells | 264/273 X |
| 3,431,160 | 3/1969 | Akira Usus et al. | 264/127 X |
| 3,501,360 | 3/1970 | Mancel | 264/127 X |
| 3,551,067 | 12/1970 | Wissman | 415/197 |
| 4,263,247 | 4/1981 | Berger et al. | 264/273 |

FOREIGN PATENT DOCUMENTS

| | | | |
|---|---|---|---|
| 256056 | 8/1963 | Australia | 415/214 |
| 2318752 | 10/1914 | Fed. Rep. of Germany | 415/197 |
| 1510829 | 5/1918 | United Kingdom | 415/196 |

OTHER PUBLICATIONS

The Duriron Company, Inc, Bulletin IP/6 "Durco T--Line Strainer" (Jul. 1980).

E. I. DuPont De Nemours & Co., Inc. "Injection Molding of Teflon PFA-TE-9704" (undated).

*Primary Examiner*—Harvey C. Hornsby

*Assistant Examiner*—Frankie L. Stinson

*Attorney, Agent, or Firm*—Biebel, French & Nauman

[57] ABSTRACT

A lined pump is provided including a casing and cover assembly forming a chamber having an inlet and an outlet. The fluid contacted surfaces of the pump are lined with PFA resin. These linings may be formed by an injection or other suitable molding process and are restrained against undesirable movement by locking plates. The locking plates may take the form of perforated metal plates attached to the pump casing and cover through which the resin flows during molding so as to become embedded in areas of the liners and lock those areas in place. Proper placement of the locking plates provides both restrained and unrestrained liner areas which permit the dissipation of built up internal stresses in the resin material due to thermal and hydraulic forces. This avoids cracking and failure while preserving the dimensional stability of the liners.

7 Claims, 7 Drawing Figures

LINED CORROSION RESISTANT PUMP

BACKGROUND OF THE INVENTION

The present invention relates to pumps and more particularly to an improved centrifugal pump for use with corrosive materials in which the pump chamber and impeller are fully lined with a polymeric plastic material such as perfluoroalkoxy (PFA) resin.

A wide variety of materials have been used in the past in attempts to protect pump parts which are in contact with corrosive liquids. Corrosion resistant metal alloys have been used but have had a number of drawbacks to their use including cost, difficulty of machining or casting parts, strength problems, and brittleness. Ceramics and glasses have been used as linings in pumps because of their inertness to most corrosive materials. However, they are quite brittle and susceptible to thermal and mechanical shock resulting in their failure.

Thermoplastic and thermosetting polymeric materials have also been used both as solid pump parts and as linings in pumps. Among these, the fluorocarbon polymers such as polytetrafluoroethylene (PTFE) and fluorinated ethylene-propylene copolymer (FEP) have found widespread use. For example, Wissman U.S. Pat. No. 3,551,067, assigned to the assignee of the present invention, discloses a centrifugal pump lined with PTFE which protects all exposed surfaces of the pump from corrosive materials. However, although PTFE possesses excellent corrosion resistance to a variety of materials over a wide range of temperatures, because of its exceptionally high melt viscosity, it cannot be processed by conventional extrusion or molding techniques. The processing steps required to produce a PTFE lined pump require significant amounts of both time and labor.

FEP has most of the desirable corrosion resistant properties of PTFE with the important advantage of being melt processable. That is, it can be processed by conventional thermoplastic techniques. However, its service temperature is less than that of PTFE. Perfluoroalkoxy (PFA) resin is similar to both PTFE and FEP in properties. Like FEP, it can be processed by conventional melt processing techniques. It does have better mechanical properties and dimensional stability than FEP at elevated service temperatures (i.e., temperatures above 150° C.).

However, problems have been encountered in using such fluorocarbon polymers as linings in pumps because of the tendency of such polymers to cold flow under the hydraulic and clamping pressures and changes in temperature encountered during operation. Because of the close tolerances required between the pump casing and pumping element such as an impeller, such flow is undesirable and may cause failure of the pump. Adddition-ally, stresses are introduced into the lining during molding with additional stresses being caused by the high coefficient of expansion of the polymers in relation to the metal casing. These stresses in conjunction with the shrinkage which occurs in the lining after molding causes the lining to stress crack and fail during service. Previous attempts to restrain movement (cold flow) of the polymers during service such as by providing locking grooves have only contributed to the stress cracking problem.

Accordingly, the need exists in the art for a means of restraining undesirable movement of such polymer lining materials to preserve structural and dimensional integrity while dispersing the inherent stresses found in such linings and without causing their catastrophic failure (cracking).

SUMMARY OF THE INVENTION

The present invention meets that need by providing a pump, which may be of the centrifugal type, in which all fluid contacted surfaces of the pump chamber are coated with a relatively thin coating or liner of a suitable plastic such as PFA resin which has been restrained or secured against movement in predetermined areas to promote dimensional stability of the liner while at the same time permitting the relieving of stresses introduced into the liner by hydraulic, clamping, and thermal forces. The liner is of sufficient thickness to prevent the passage of corrosive chemicals therethrough while being sufficiently thin to be characterized as a coating or liner.

In a preferred embodiment of the invention, the chamber of the pump is formed by a casing and cover assembly each formed with a liner of PFA resin, the liner also acting as a seal between these parts. The chamber is provided with an inlet and an outlet, also lined with PFA resin. Each of the inlet and outlet passages also includes a flange of PFA resin which is integral with the associated liner thereby forming a seal with the attached piping.

Received within the chamber is an impeller which is also made corrosion resistant either by lining it with PFA resin to form an encapsulated impeller or forming it from a corrosion resistant metal. The impeller is driven by a shaft which preferably includes a PFA resin sleeve thereon, and in the case of an encapsulated impeller, integrally formed with the coating of the impeller.

The linings on the pump casing and cover assemblies include peripheral portions in facing sealed relationship, and locking means are provided to secure both the peripheral portions of the linings as well as that portion of the casing lining immediately adjacent the impeller blades. In a preferred embodiment of the invention, these locking means comprise perforated metal plates, discs, or bands attached by welding or other suitable means to the surface of the pump casing and cover. The perforations can be of any shape although it is preferred that circular perforations be utilized.

The metal of the pump casing or cover immediately beneath the locking means may have a spiral, radial, or concentric groove pattern cut therein which provides space beneath the locking means for the extruded plastic liner material to flow. Alternatively, the locking means may be fabricated with an undulation or slight bow or may be undulated or bowed slightly as they are attached to the casing or cover to create a space between the locking plate and casing or cover. When the PFA resin material is molded into a liner by an injection or other molding technique, the plastic is extruded through the perforations in the locking plates, discs, or bands and flows under the plates so that the plastic totally envelops the plates, discs, or band and the locking plates, discs or bands becomes embedded in those areas of the liner. As a result, the PFA resin liner is reinforced and secured against undesirable movement in critical areas of the pump casing and cover and is resistant to all of the thermal expansion forces and internal stresses produced during the molding operation as well as during normal operation of the pump. The non-reinforced or unsecured areas of the liner are located to permit differential thermal expansion and internal strain to take place in these areas to dissipate any stresses being built up in the liner.

It is this combination of secured and unsecured lining areas which achieves the dimensional stability and structural integrity of the pump and lining. Indiscriminant restraint of the liner will result in dimensional degradation and/or stress cracking of the liner. However, the present invention combines the proper placement of locking means to secure the plastic liner with unsecured areas to aid in dissipating internal stresses in the liner. The spacing and size of the perforations and the geometry of the locking plates also aid in dispersing stresses over an appropriate area to avoid catastrophic failure of the lining.

Accordingly, it is an object of the present invention to provide locking means for restraining undesirable movement of polymeric lining materials in a lined pump to preserve the structural and dimensional integrity of the lining while dispersing inherent stresses found in such linings and to prevent cracking and failure of them. This and other objects and advantages of the invention will become apparent from the following description, the accompanying drawings, and the appended claims.

DESCRIPTION OF THE PREFERRED EMBODIMENTS

Figure 1:
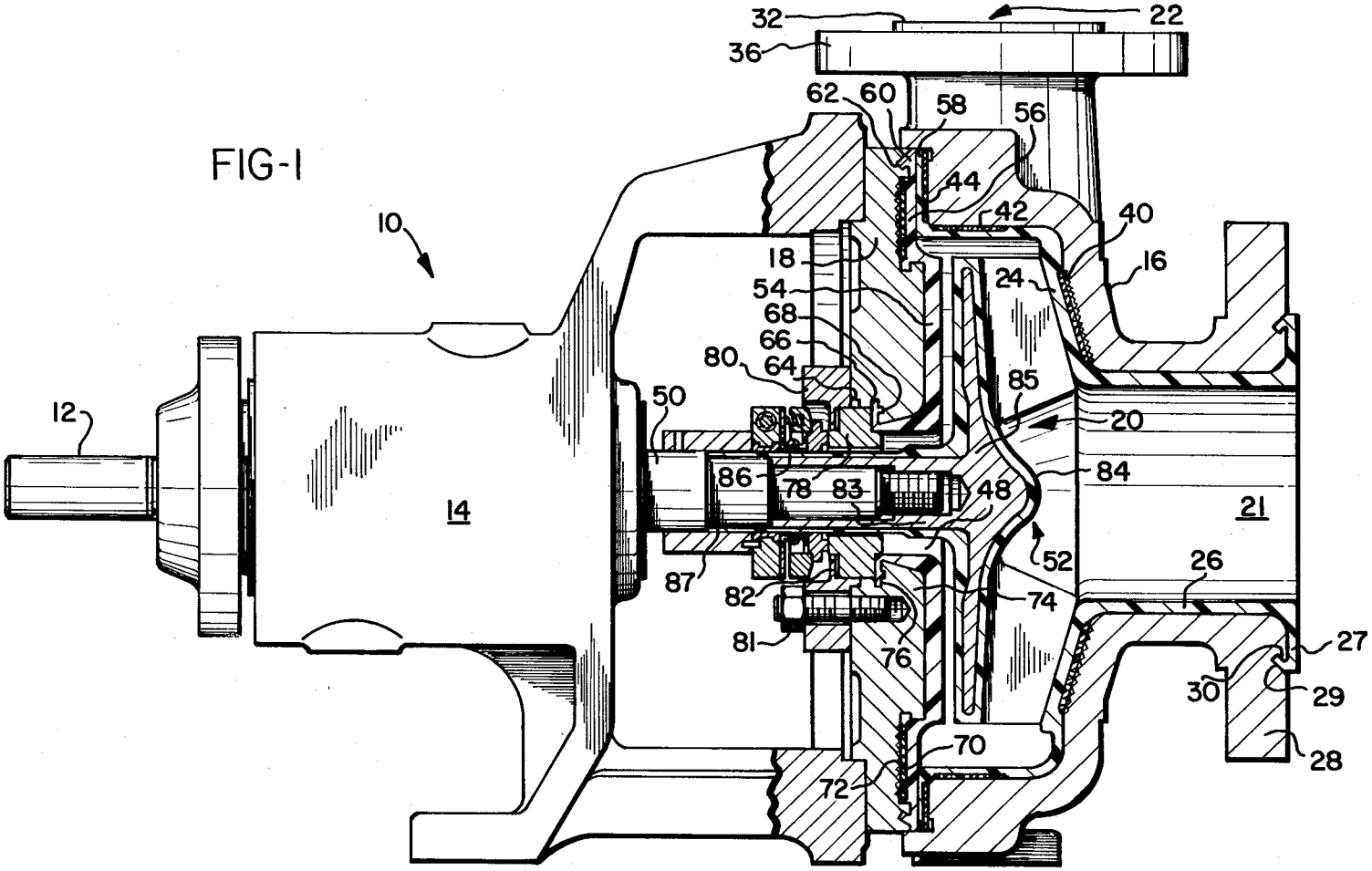
FIG. 1 is a view partly in section and partly in elevation of a lined pump in accordance with the present invention.

Referring now to the drawings which illustrate a preferred form of the invention, FIG. 1 shows a pump 10 including an impeller drive shaft 50 supported by a bearing housing 14. Neither the motor nor internal bearings are shown for sake of simplicity and because they do not directly related to the disclosed invention. Further detail concerning these elements as well as other elements of the pump structure not directly related to the present invention may be found in U.S. Pat. Nos. 3,551,067 and 3,169,486, assigned to the assignee of the present invention, the disclosures of which are hereby incorporated by reference.

The pump 10 includes a casing 16 and a rear cover assembly 18 which form therebetween a chamber 20. In the embodiment illustrated, the casing 16 includes an inlet 21 and an outlet 22, each adapted to receive conduits to form a supply line and a discharge line. The rear cover assembly 18 is secured to the casing 16 by bolts or other suitable attachment means (not shown). The casing and cover assembly because they are shielded from contact with any corrosive materials, may be fabricated of ductile iron or other easily machinable metal or may be a high strength plastic.

Figure 4:
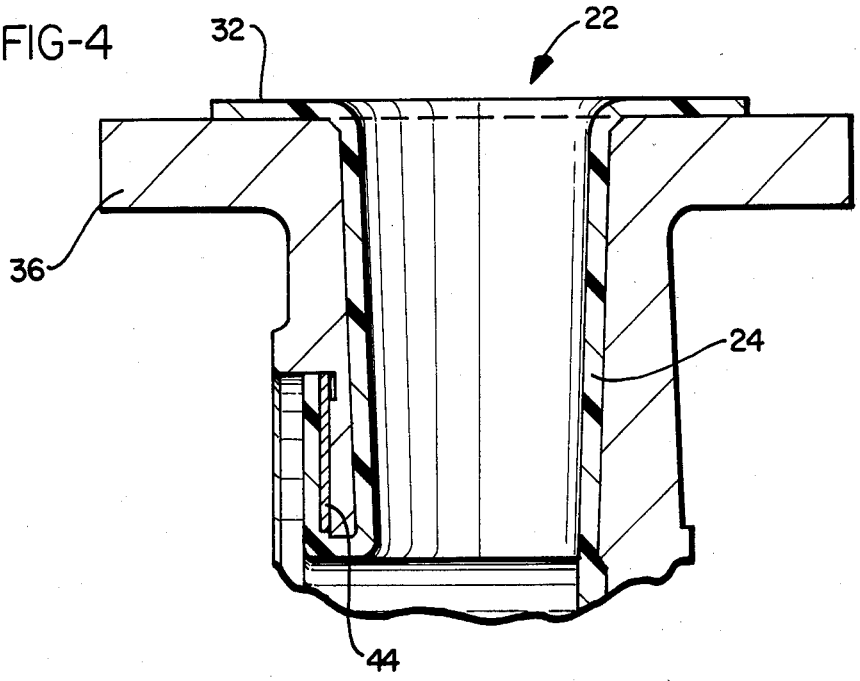
FIG. 4 is a view of a section of the pump shown in FIG. 1.

The interior fluid contacted surface portions of the casing 16 include a sheath or liner 24 thereon of PFA resin which is of sufficient thickness to prevent passage through the liner of corrosive materials. A suitable PFA resin is available under the trademark Teflon 350 from E.I. duPont DeNemours Co. The liner 24 includes an integral neck portion 26 extending through the inlet opening 21 and a flared portion 27 locked into place in flange 28 on the inlet via an annular undercut 29. Tip 30 of flared portion 27 of the liner is angled at approximately 45° so that it locks the liner into position against radial movement. The outlet end of liner 24 also includes a flared end 32 of a second integral neck portion 34 (see FIG. 4) which locks it into position on flange 36. The liner may be formed by suitable molding techniques such as injection molding directly into the pump casing, transfer molding, or compression molding, with injection molding being the preferred technique as will be explained in further detail below. The molding techniques per se are known.

Figure 2:
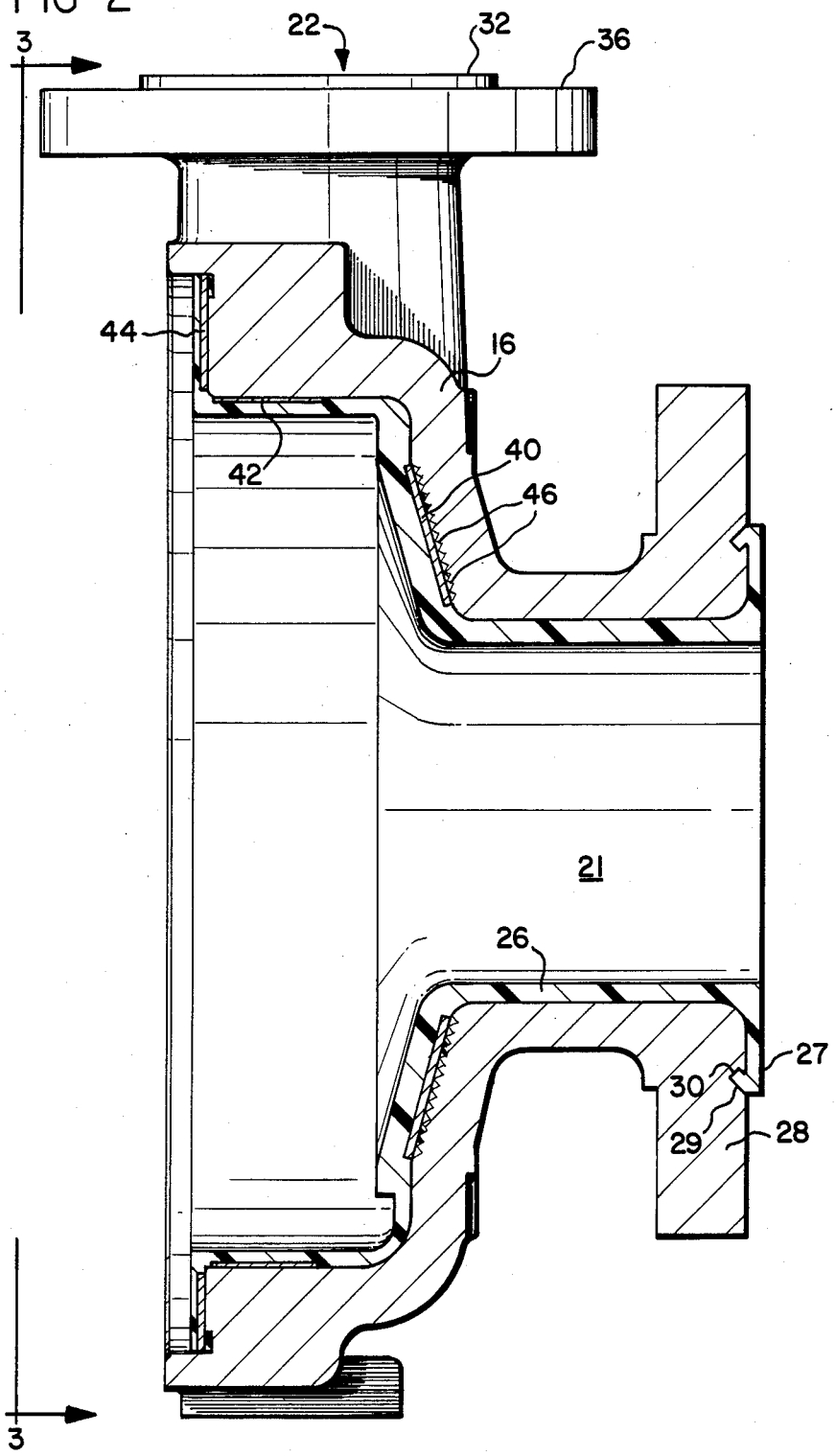
FIG. 2 is an enlarged side view partly in section and partly in elevation of the pump casing and lining.
Figure 3:
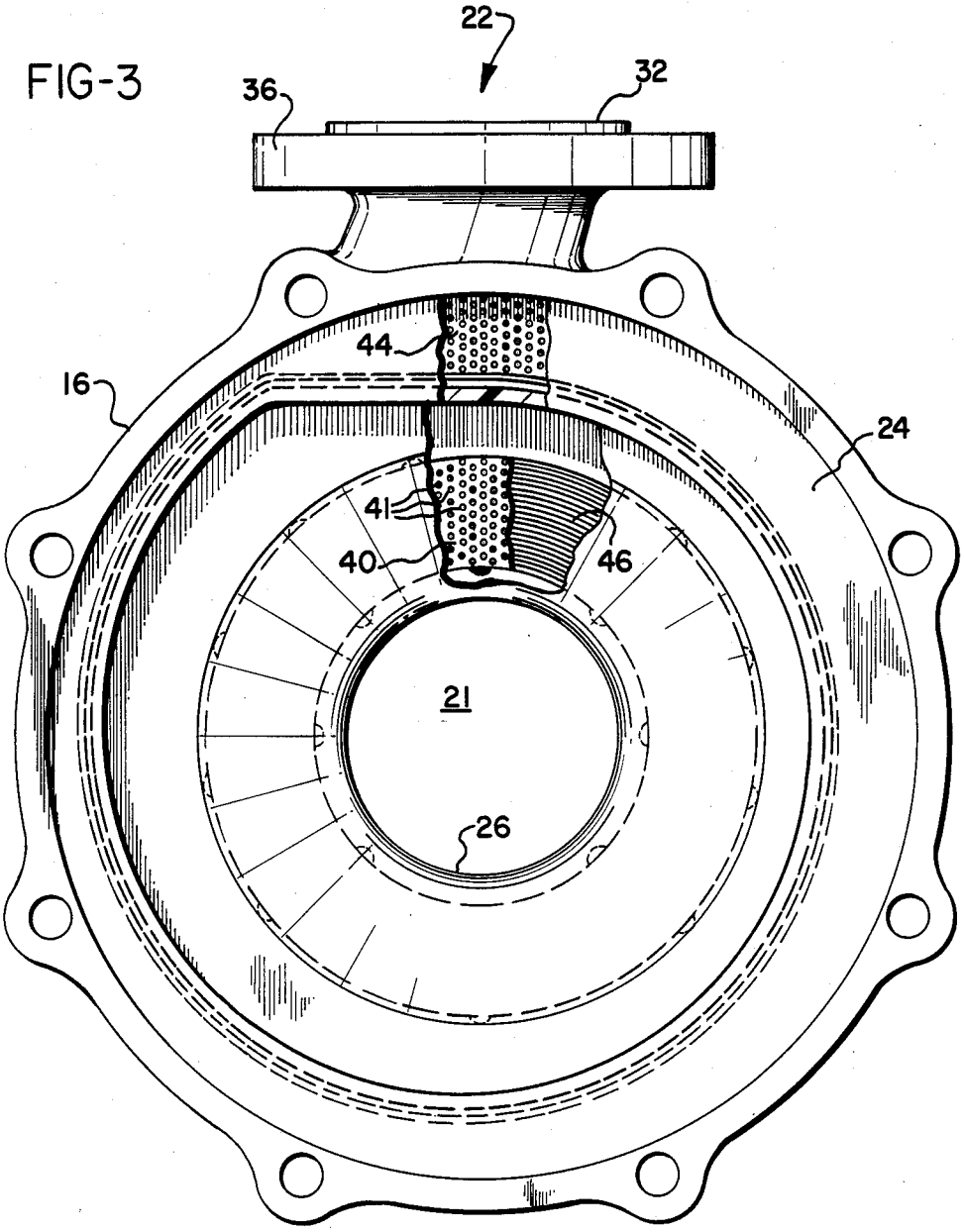
FIG. 3 is a view partly in section partly in elevation of the pump casing taken along line 3—3.

As best shown in FIGS. 2 and 3, the PFA resin liner 24 is restrained or secured against undesirable movement by locking plates 40, 42, and 44, respectively. These plates may be formed of any suitable material, preferably a metal which has a coefficient of thermal expansion which closely matches that of the pump casing, and are attached to casing 16, in a preferred embodiment, by welds. Other suitable means of attaching the plates to the casing will be immediately apparent to the skilled artisan. While locking plates 40, 42, and 44 are illustrated as being perforated plates, discs, and bands, other constructions such as woven wire or expanded metal mesh may also be utilized. Additionally, the shape and pattern of perforations through the plates may be varied although it is preferred that the perforations be circular in cross-section. For example, the locking plates may be 16 guage metal (cold or rolled or stainless steel) with 0.072 inch diameter holes on 0.125 inch centers. Somewhat lighter or heavier gauge metal may be utilized depending on the size of the pump and the need for rigidity and dimensional stability of the part.

The ratio, of open area to metal can be varied over a wide range although it is preferred to have an open area of between about 36–50 percent of the total surface area of the locking plate. The greater the open area utilized, the thicker the gauge of the metal needed for the locking plate. Moreover, with larger pump sizes, there is a need for larger diameter holes in those locking plates located in the interior of such pumps because of the need for the flow of plastic during the molding operation through the holes but at the somewhat reduced molding pressures achievable in the pump interior. The objective is to achieve a maximum amount of surface area of plastic locked or secured to the plate and yet maintain the structural integrity of the plate. The hole size, geometry, and spacing and the thickness of the locking plate may be varied to meet that objective.

Figure 6:
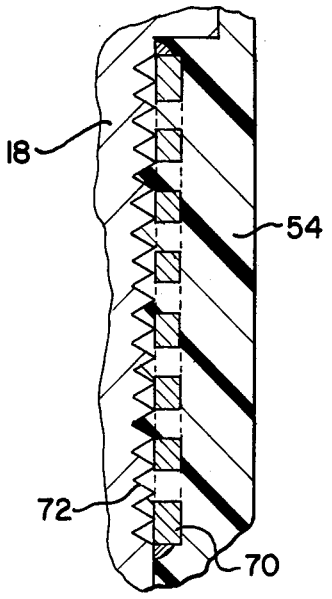
FIG. 6 is an enlarged fragmentary sectional view of a locking plate secured to a pump cover having underlying grooves in accordance with the present invention.

As shown, locking plate 40 is a conically shaped disc having perforations 41 and which is attached to casing 16 by means of a plurality of welds. The surface of casing 16 immediately underlying locking plate 40 has a pattern of grooves 46 which permits the plastic to flow through perforations 41 during molding and completely envelop the locking plate as best shown in FIG. 6. The groove pattern may be concentric, spiral, or radial, with a concentric pattern being preferred.

Figure 7:
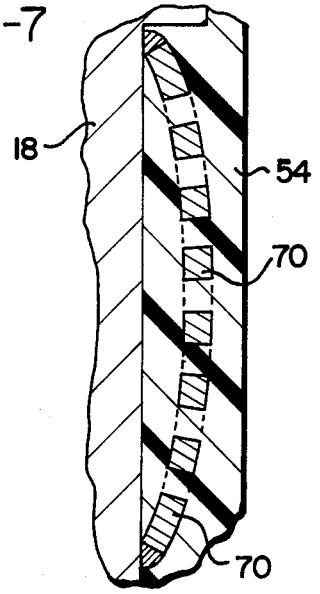
FIG. 7 is an enlarged fragmentary sectional view of a locking plate secured to a pump cover with the inward bow being exaggerated for purposes of illustration.

Alternatively, grooves 46 underlying the locking plates may not be required. The locking plates may either be fabricated or positioned during attachment so that they have an undulated configuration or bow slightly inwardly away from the casing and form a pocket into which plastic may flow during the molding operation an example of which is best shown in FIG. 7. As shown, locking plates 42 and 44 do not have a pattern of grooves underlying them.

Figure 5:
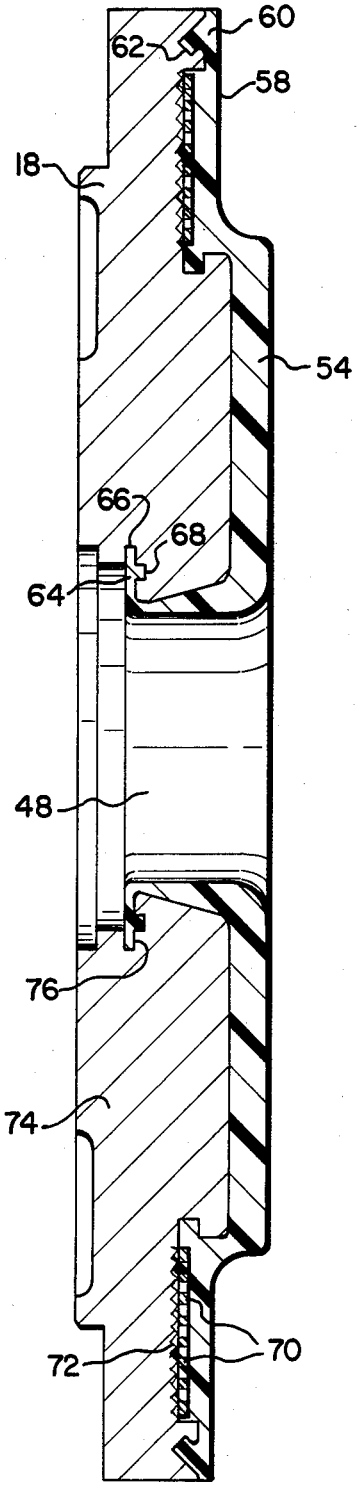
FIG. 5 is an enlarged sectional view of the pump cover and lining.

Referring to FIGS. 1 and 5, the rear cover assembly 18 is provided with an opening 48 through which drive shaft 50 of the impeller 52 extends. All fluid contacted surfaces of the cover assembly 18 are covered with a second liner 54 of PFA resin which is sufficiently thick to prevent passage therethrough of corrosive materials. Liner 54 includes a peripheral outer portion 56 which is in facing relationship to peripheral outer portion 58 on liner 24. These portions of liners 24 and 54 operate to provide a seal between the rear cover assembly 18 and casing 16.

Liner 54 is secured to rear cover assembly 18 at three locations. Tip 60 at the edge of outer peripheral portion 56 mates with an annular undercut 62 in cover plate 18 to secure the outer portion of the liner 54 against radial movement. Inner tip 64 of the liner mates with two annular undercuts 66 and 68, respectively, at the rear of cover assembly 18 to secure the inner portion of liner 54. As shown undercuts 66 and 68 are normal to each other. Finally, locking plate 70 which forms a generally circular-shaped disc, welded or otherwise attached to cover assembly 18, acts to secure that portion of liner 54 immediately adjacent impeller 52 to cover plate 18. As shown, a series of grooves 72 may immediately underly locking plate 70 to provide space for the plastic liner material to flow through and lock itself to the plate during the molding operation. Alternatively, as explained above and shown in FIG. 7, locking plate 70 may be fabricated or welded in position to have a slight inward bow or series of bows which provides space behind the plate for plastic to flow.

The opening 48 through the rear cover assembly 18 includes an annular shoulder 74 having a shallow annular counter bore 76 therein. Received in opening 48 between rear cover assembly 18 and shaft 50 is a corrosion resistant seal seat 78 which is generally T-shaped in cross-section. Seat 78 engages the inner tip 64 of liner 54 to force a portion of the liner into the counter bore 76 for anchoring the inner peripheral portion of the liner. The annular corrosion resistant seal seat 78 is clamped against rear cover assembly 18 by clamp ring 80 which is held in place by studs 81, annular cushioning gasket 82 being placed therebetween. The seal seat 78 may be of ceramic, tungsten carbide, carbon, or other suitable material.

Received within chamber 20 is an impeller 52 of the open impeller type and which is provided with a hollow threaded shank 63 which receives the threaded end of drive shaft 50 as shown. The outer surface of impeller 52 may be coated with a PFA resin coating 84 formed over a metal impeller blank 85 to form an encapsulated impeller. Alternatively, the impeller may be formed of a corrosion resistant metal. The outer surface of the shank 83 includes a PFA resin sleeve 86 integral with coating 84 and extending over a bearing surface 87 formed on the impeller drive shaft 50.

Shaft 50 is sealed to rear cover assembly 18 by a bellows type seal including a rotating annular sealing member which is urged into engagement with the sealing face of annular seal seat 78. This type of seal structure per se is known and is described in further detail in the above referenced U.S. Pat. No. 3,551,067. The rotating annular sealing member prevents the passage of fluid between it and seal seat 78 while the sealed bellows assembly prevents the passage of fluid along shaft 50. Other forms of seals may be used as will be apparent to those skilled in the art, for example, single and double internal mechanical seals.

The PFA resin liners of the present invention are secured by the locking plates as illustrated against undersirable movement in critical areas of the pump casing and cover. On the pump casing, these areas include the area immediately adjacent the rotating impeller (locking plates 40 and 42) and the outer periphery of the liner (locking plate 44). On the cover assembly, these areas include the outer periphery of the liner immediately behind the rotating impeller.

However, it is an equally important aspect of the present invention that certain areas of the liners are not secured or locked to the pump casing or cover. These unsecured areas include neck 26 of liner 24 and the central portion of liner 54. These unsecured areas are located to permit movement of the plastic material and to dissipate differential thermal expansion and internal stresses built up during operation of the pump. It is this combination of the proper placement of secured and unsecured lining areas which achieves the dimensional stability and structural integrity of the pump components and linings.

In a preferred embodiment of the invention the PFA liners are formed by an injection molding process using a reciprocating screw-type injection molding machine. Such machines are commercially available from various manufacturers including HPM Corp., Cincinnati, Ohio, and Van Dorn Machinery Co., Cleveland, Ohio. In forming the lining for the pump casing, the casing itself forms one portion of the mold while a core element forms the other portion.

In preparation for molding, both the casing and core element are heated to near the melt temperature of the polymeric resin to be injected. In the case of a PFA resin, this temperature will be about 580°–600° F. The core element may have heating means such as electrical resistance wires within it, and the pump casing may be preheated in a convection oven or the like.

The core element and casing are then assembled, clamped together, and openings sealed off in preparation for injecting the resin. A reciprocating screw-type device having a heated barrel is used to heat the resin up to the stock temperature specified by the manufacturer of the resin so that it is in a flowable condition. The screw then acts as a ram to inject a shot of resin into the mold.

The pressure developed by the screw should be sufficient so that the injected resin will completely fill the mold. Typically, pressures in the range of about 3,000 to 20,000 psi are developed. Also the pressures developed during injection will vary with time with higher pressures being developed near the start and then being lowered.

The cycle time for the injection molding process will vary depending upon the size of the pump to be lined. For example, for a $3\times11/2\times6\frac{1}{2}$ pump and PFA resin the cycle time will typically be about 12 minutes with the actual injection process taking up 2 of those 12 minutes. Of course it will be apparent to those skilled in the art that the process parameters of heat, pressure, and time will all vary depending upon the size and shape of the part to be molded and the particular polymeric resin used. The basic objective is to control these variables and the rate of injection so that the resin will fill all mold cavities while in its melted state while avoiding the creation of turbulent flow or high shear stresses.

Once the resin is injected into the mold, the resin is solidified using directional cooling. Separate cooling zones inside the core element may be provided through which a coolant, preferably air but also including liquid coolants, is circulated to control the cooling process. Once cooled below the melt temperature of the resin, the molded part may be ejected by a standard ejecting mechanism and allowed to cool to room temperature. The gate and any other areas which require it are then machined off. Finally, the molded part is pressure and spark tested to check for the integrity of the lining, homogeneity of the resin, and the presence of any voids. Although the molding process has been described with particular reference to PFA resin, other polymeric resins, including both melt processable fluorocarbon and non-fluorocarbon polymers can be used to form the liner material.

The features of the present invention, while described with reference to a centrifugal pump, may also be used for in-line pumps, positive displacement pumps, and the like in which a pumping element rotates within a fully lined pump chamber. The present invention may also find use in lined valves, conduits, and the like where there is a need for a corrosion resistant environment.

While the forms of apparatus herein described constitute preferred embodiments of the invention, it is to be understood that the invention is not limited to these precise forms of apparatus, and that changes may be made therein without departing from the scope of the invention which is defined by the appended claims.

What is claimed is:

1. A pump for use with corrosive materials wherein said pump includes a casing and a cover assembly defining therebetween a chamber through which fluid is pumped, a pumping element received within said chamber and cooperating therewith to force fluid through said chamber, drive shaft means extending within said chamber and connected to said pumping element for effecting rotation thereof within said chamber, said chamber including means communicating therewith and forming an inlet and an outlet for fluid being pumped, first corrosion-resistant plastic liner means covering all fluid contacted surfaces of said casing and having peripheral portions which extend beyond said fluid contacted surfaces, second corrosion-resistant plastic liner means covering all fluid contacted surfaces of said cover assembly and having peripheral portions which extend beyond said fluid contacted surfaces, means for securing said peripheral portions of said first and second liner means against radial movement, said casing including perforated means attached thereto in the region of the fluid contacted portions of said first liner means and embedded in said first liner means for securing areas of said fluid contacted surfaces of said first liner means against movement and so positioned that through cooperation with unsecured areas of said fluid contacted surfaces of said first liner means internal stresses in said first liner means are dissipated during operation of said pump, and said cover assembly including perforated means attached thereto in the region of the fluid contacted portions of said second liner means and embedded in said second liner means for securing areas of said fluid contacted surfaces of said second liner means against movement and so positioned that through cooperation with unsecured areas of said fluid contacted surfaces of said second liner means internal stresses in said second liner means are dissipated during operation of said pump.

2. The pump of claim 1 in which said first and second liner means are fabricated of a perfluoroalkoxy resin.

3. The pump of claim 1 in which said means attached to said casing for securing said first liner means includes at least one locking plate having perforations therethrough.

4. The pump of claim 1 in which said means attached to said cover assembly for securing said second linar means includes at least one locking plate having perforations therethrough.

5. A pump for use with corrosive materials wherein said pump includes a casing and a cover assembly defining therebetween a chamber through which fluid is pumped, a pumping element received within said chamber and cooperating therewith to force fluid through said chamber, drive shaft means extending within said chamber and connected to said pumping element for effecting rotation thereof within said chamber, said chamber including means communicating therewith and forming an inlet and an outlet for fluid being pumped, first corrosion-resistant plastic liner means covering all fluid contacted surfaces of said casing and having peripheral portions which extend beyond said fluid contacted surfaces, second corrosion-resistant plastic liner means covering all fluid contacted surfaces of said cover assembly and having peripheral portions which extend beyond said fluid contacted surfaces, means for securing said peripheral portions of said first and second liner means against radial movement, said casing including means attached thereto and embedded in said first liner means for securing areas of said first liner means against movement and so positioned that through cooperation with unsecured areas of said first liner means internal stresses in said first liner means are dissipated during operation of said pump, and said cover assembly including means attached thereto and embedded in said second liner means for securing areas of said second liner means against movement and so positioned that through cooperation with unsecured areas of said second liner means internal stresses in said second liner means are dissipated during operation of said pump.

and wherein said means attached to at least said casing or said cover assembly for securing the liner means thereto includes at least one locking plate having perforations therethrough and further wherein the area on said casing or said cover assembly immediately underlying said locking plate contains grooves.

6. the pump of claim 5 in which said grooves are concentric.

7. A pump for use with corrosive materials wherein said pump includes a casing and a cover assembly defining therebetween a chamber through which fluid is pumped, a pumping element received within said chamber and cooperating therewith to force fluid through said chamber, drive shaft means extending within said chamber and connected to said pumping element for effecting rotation thereof within said chamber, said chamber including means communicating therewith and forming an inlet and an outlet for fluid being pumped, first corrosion-resistant plastic liner means covering all fluid contacted surfaces of said casing and having peripheral portions which extend beyond said fluid contacted surfaces, second corrosion-resistant plastic liner means covering all fluid contacted surfaces of said cover assembly and having peripheral portions which extend beyond said fluid contacted surfaces, means for securing the peripheral portions of said first and second liner means against radial movement, said casing including means attached thereto in the region of the fluid contacted portions of said first liner means and embedded in said first liner means for securing areas of said first liner means against movement and so positioned that through cooperation with unsecured areas of said first liner means internal stresses in said first liner means are dissipated during operation of said pump, and said cover assembly including means attached thereto in the region of the fluid contacted portions of said second liner means and embedded in said second liner means for securing areas of said second liner means against movement and so positioned that through cooperation with unsecured areas of said second liner means internal stresses in said second liner means are dissipated during operation of said pump, and wherein said means attached to at least said casing or said cover assembly for securing the liner means thereto includes at least one locking plate having perforations therethrough and being undulated or bowed to form a pocket between said locking plate and said casing or cover assembly for the plastic in said plastic liner means to flow into.

* * * * *